US005495921A

United States Patent [19]

Samulak et al.

[11] Patent Number: 5,495,921

[45] Date of Patent: Mar. 5, 1996

[54] SINGLE ACTUATOR TRUCK MOUNT BRAKE SYSTEM

[75] Inventors: Zdzislaw Samulak, Watertown; Lyle Jantzi, Adams, both of N.Y.

[73] Assignee: New York Air Brake, Watertown, N.Y.

[21] Appl. No.: 390,523

[22] Filed: Feb. 17, 1995

Related U.S. Application Data

[63] Continuation-in-part of Ser. No. 118,719, Sep. 10, 1993, Pat. No. 5,400,874.

[51] Int. Cl.[6] ..... F16D 65/56

[52] U.S. Cl. ..... 188/202; 188/52; 188/196 V

[58] Field of Search ..... 188/196 R, 197, 188/198, 199, 202, 203, 196 P, 196 D, 196 V, 52, 53, 54, 207, 219.1, 217, 220.1

[56] References Cited

U.S. PATENT DOCUMENTS

| | | | |
|---|---|---|---|
| 3,177,984 | 4/1965 | Taylor | 188/197 |
| 3,298,474 | 1/1967 | Roselius et al. | 188/200 |
| 3,378,108 | 4/1968 | McClure et al. | 188/52 |
| 3,406,791 | 10/1968 | Williams | 188/52 |
| 3,499,507 | 3/1970 | Scott et al. | 188/52 |
| 3,731,766 | 5/1973 | Campbell | 188/202 X |
| 3,780,837 | 12/1973 | Haydu | 188/52 X |
| 3,899,053 | 8/1975 | Nadas | 188/203 |
| 3,970,173 | 7/1976 | Sander | 188/203 |
| 4,019,426 | 4/1977 | Wosegien et al. | 92/113 |
| 4,128,148 | 12/1978 | Schmitt | 188/197 |
| 4,193,480 | 3/1980 | Malo | 188/52 |
| 4,385,548 | 5/1983 | Persson et al. | 188/196 D X |
| 4,431,089 | 2/1984 | Nadas et al. | 188/196 D |
| 4,493,246 | 1/1985 | Dalibout | 188/196 P X |
| 4,716,995 | 1/1988 | Nilsson et al. | 188/197 |
| 4,771,868 | 9/1988 | Haydu | 188/52 |
| 4,775,035 | 10/1988 | Brodeur et al. | 188/52 X |
| 4,793,446 | 12/1988 | Hart et al. | 188/52 |
| 4,942,945 | 7/1990 | Rocholl et al. | 188/202 |
| 5,031,731 | 7/1991 | McKay | 188/196 BA |
| 5,069,312 | 12/1991 | Kanjo et al. | 188/52 |
| 5,259,485 | 11/1993 | Jackson | 188/198 |
| 5,400,874 | 3/1995 | Gayfer et al. | 188/52 |

OTHER PUBLICATIONS

NYCOPAC IIA, Truck Mounted Brake System, Conversion Kit, Technical Guide for The Product User, New York Air Brake.

NYCOPAC II, Unit Brake System, Technical Guide for The Product User, New York Air Brake.

*Primary Examiner*—Robert J. Oberleitner
*Assistant Examiner*—Peter M. Poon
*Attorney, Agent, or Firm*—Barnes & Thornburg

[57] ABSTRACT

A slack adjuster for use in combination with a pneumatic brake actuator cylinder wherein the slack adjuster includes a friction clutch which prevents rotation of the screw for first relative position of the piston and screw while allowing rotation of the screw for excess force on the ram pulling the screw to a relative position beyond the first relative position and opposite the relative position for normal slack adjustment in response to air actuation of the piston. A second clutch, which is a standard toothed clutch, prevents rotation of the screw for second relative position of the piston and the screw. The screw rotates between the first and second relative positions when the two clutches are unlocked to produce slack adjustment. The pulling force on the slack adjuster is produced by a hand brake on the output of the slack adjuster and independent of the piston.

9 Claims, 3 Drawing Sheets

SINGLE ACTUATOR TRUCK MOUNT BRAKE SYSTEM

CROSS REFERENCE

This is a continuation-in-part of application Ser. No. 08/118,719 filed Sep. 10, 1993, now U.S. Pat. No. 5,400,874 issued Mar. 28, 1995.

BACKGROUND AND SUMMARY OF THE INVENTION

The present invention relates to truck-mounted brakes for a railroad vehicle and more particularly to an improved single actuator for truck mounted brakes.

The accepted truck mounted brakes throughout the railroad industry approved by AAR is a double actuator system known as NYCOPAC sold by New York Air Brake Corporation and its equivalent WABCOPAC sold by Westinghouse Air Brake Corporation. Two actuators are used, one connected to each brake beam on opposite sides of the center axis. An example of the structure is illustrated in U.S. Pat. No. 3,499,507. The next generation of truck mounted brake includes a single actuator, truck mounted brake assembly known as NYCOPAC II and WABCOPAC II. This structure includes a single actuator with a pair of force transmitting arms and a lever connected to the opposite, brake beam. A typical example of this structure is illustrated in U.S. Pat. No. 4,793,446.

As illustrated in U.S. Pat. No. 3,499,507, the slack adjuster is provided on the opposite end of the force transmitting device from the actuator and in the opposing brake beam. The NYCOPAC and WABCOPAC have no slack adjuster. In the single actuator system illustrated in U.S. Pat. No. 4,793,446 the slack adjuster is on the return force transmitting device. It is important that the force transmitting elements and the slack adjuster do not intersect the openings in the bolster for the various angular positions of the force transmitting elements.

The single actuator, truck mounted brake provides a force generated by the brake cylinder multiplied by a factor of four. This system is very effective as a force generated by the brake cylinder is transferred to the center of the arc of each of the shoes equally. The center of the force in the middle of each of the shoes eliminates wasted torsional components that exist in other systems.

The NYCOPAC II including a double acting slack adjuster brake cylinder having air on one side of the piston to apply the brakes and a spring return. The hand brake is connected to the piston directly by a series of cables, rods and chains. Since the hand brake worked directly on the piston, the slack adjuster operated the same when actuated by air as well as the hand operated brakes. In a single actuator system illustrated in U.S. Pat. No. 4,793,446, wherein the slack adjuster is in the return force transmitting element or device, the hand brake has been applied at the output of the actuator prior to the slack adjuster. This structure, as illustrated in U.S. Pat. Nos. 4,771,686 and 5,069,312, applies a single force in a common direction to the slack adjuster and thus is similar to operation to the NYCOPAC II without the use of cables or connection to the piston itself, internal the brake cylinder.

When one attempts to incorporate a hand brake connected to the output of the actuator where the actuator includes the slack adjuster thereby eliminating the cables from the NYCOPAC II, dangerous situations may be produced. The pulling forces produced by the hand brake are substantially larger than the pushing force produced by the pneumatic actuated piston. This could detrimentally affect and possibly destroy the slack adjuster. Also, if the actuator is not operated by air after replacement of brakes; the elements within the slack adjustor are not in their appropriate position and an application of the hand brake would not produce a slack adjusting operation. Thus, either the hand brake will not apply the brakes in one situation or the hand brake will produce a force which could destroy or severely damage the slack adjuster in the other extreme.

Thus, it is an object of the present invention to provide an improved single actuator and slack adjuster for use with hand brakes.

Another object of the present invention is to provide a single actuator and slack adjustor for truck mounted brake systems which will operate the same for pneumatic as well as hand brake actuation.

These and other objects are attained by a slack adjuster for use in combination with a pneumatic brake actuator cylinder wherein the slack adjuster includes a friction clutch which prevents rotation of the screw for a first relative position of the screw and piston, while allowing rotation of the screw :for excess force on the ram pulling the screw to relative position beyond the first relative position. A second clutch, which is a standard toothed clutch, prevents rotation of the screw for second relative position of the piston and screw when pressure is applied. The screw rotates when clutches are disengaged. A spring biases the piston in opposition to the fluid pressure which actuates the cylinder. In response to fluid actuation, the piston and screw are in the first relative position with the friction clutch engaged at the beginning of the extension of the ram and in second relative position, with the toothed clutch engaged, at the end of the ram extension. In response to the pulling force on the ram, the piston and screw are in the first relative position with the friction clutch engaged at the beginning and the end of the extension of the ram with correct cylinder slack. The hand brake is connected to the ram extending from the combined actuator slack adjuster. The hand brake may operate on the ram directly or through the brake beams.

Other objects, advantages and novel features of the present invention will become apparent from the following detailed description of the invention when considered in conjunction with the accompanying drawings.

DESCRIPTION OF THE PREFERRED EMBODIMENT

Figure 1:
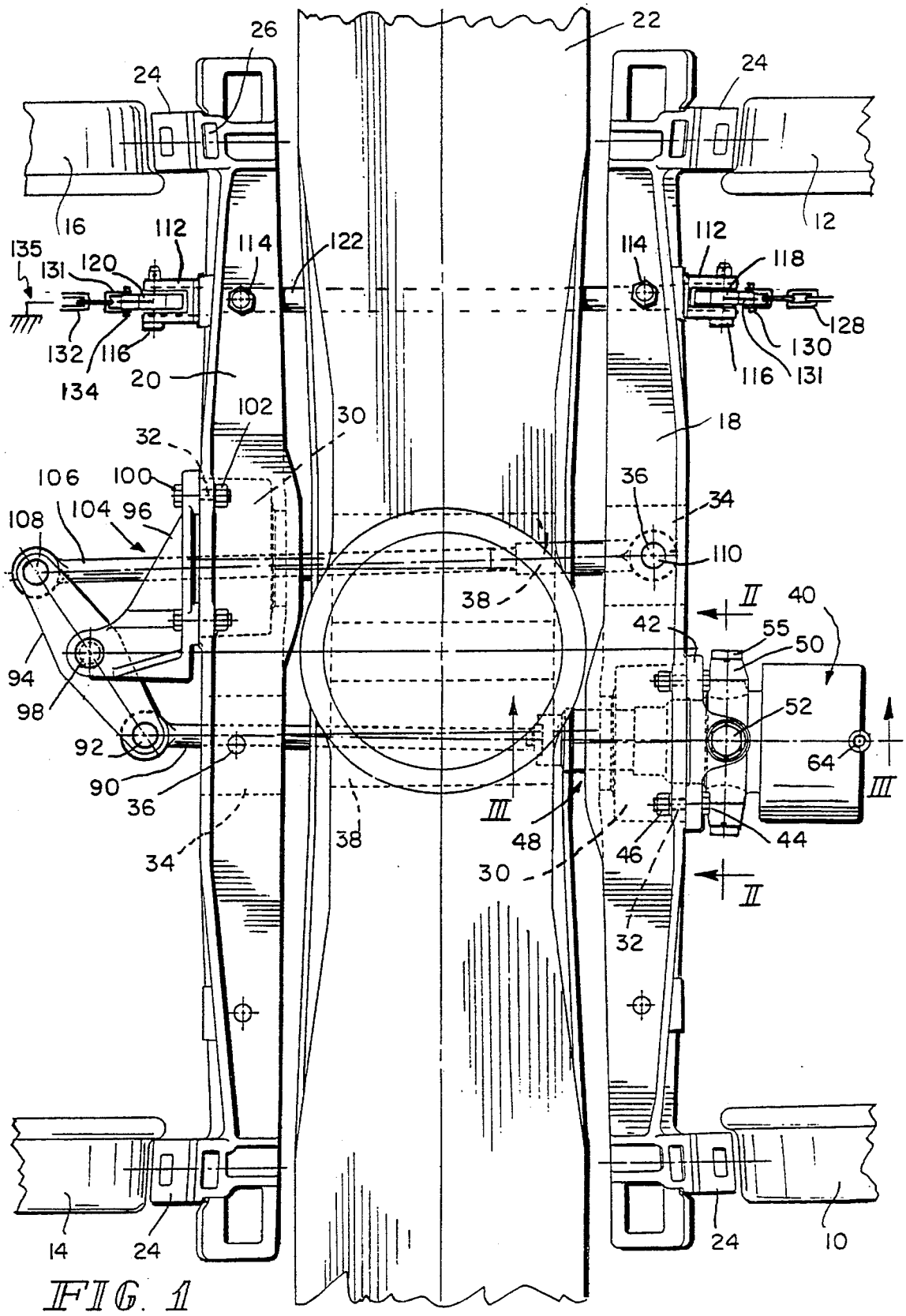
FIG. 1 is a plan view of a brake system incorporating the principles of the present invention.

A brake system for a railroad vehicle is illustrated in FIG. 1. Although the description of the system will be provided with respect to conversion of existing dual actuator, truck mounted brake systems, the present mounting structure of the single actuator is also applicable to any other truck mounted brake system or any other brake system. The existing structure of the dual actuator, brake mounted system will be described first and will be followed by the specific elements of the present system which is mounted thereto. Two pairs of wheels 10/12 and 14/16 are secured to opposites ends of a respective axle, not shown for sake of clarity, of a two-axle, four wheel railroad car truck. A pair of brake beams 18 and 20 extend crosswise of the car truck and parallel to each other and to a truck bolster 22. Brake shoes 24 are mounted to the brake head 26 at each end of the brake beams 18 and 20. The brake beams 18 and 20 have a generally U-shaped cross section. Beams have casted passage holes 30, 34 and mounting surfaces with holes 32. A pair of opposed mounting holes 36 on the top and bottom portion of the beams are used to mount the push rod 90 or the rod 106. The bolster 22 has a pair of channels 38 on each side of the center axis.

Double acting brake cylinder is mounted on one of the beams with a force transmitting element or push rod 90 extending through channels 38 in the bolster 22 and connected to opposed beam through transfer lever 94. The present brake system includes a brake actuator or cylinder 40 mounted to the brake beam 18 by a bracket 42 and an intermediate gimbal or cage 50. Bolts 44 extend through the elongated openings 43 (FIG. 2) in the bracket 42 and the mounting holes 32 in the brake beam 18 and is secured thereto by nuts 46. The cylinder 40 has double acting internal slack adjuster 48 increasing or decreasing cylinder length automatically. The slack adjuster will be discussed in detail with respect to FIG. 3.

Figure 2:
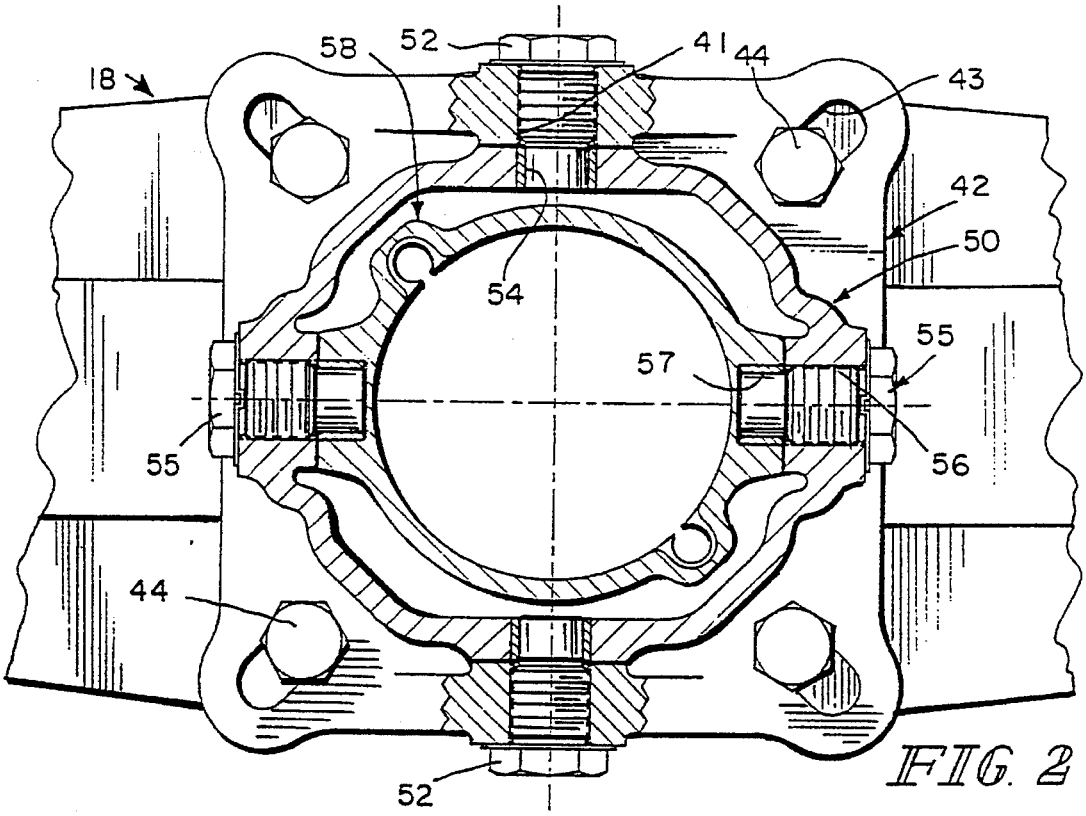
FIG. 2 is a cross sectional view of the mounting of the actuator to the brake beam taken along lines II—II of FIG. 1.

The gimbal 50 mounts the actuator brake cylinder 40 to the brake beam 18 through bracket 42 so that it freely rotates horizontally and vertically which results in high and consistent efficiency. As illustrated in FIG. 2, the gimbal 50 is mounted to the bracket 42 by fasteners 52 which are threadably received in aperture 41 of the bracket 42 and extend into a sleeve bearing 54 in the gimbal 50. A non-pressurized cylinder portion 58 is mounted to the gimbal 50 by a fastener 55 threadably received in a bore 56 of the gimbal 50 and having an end extending into bearing sleeve 57 in the cylinder portion 58.

Figure 3:
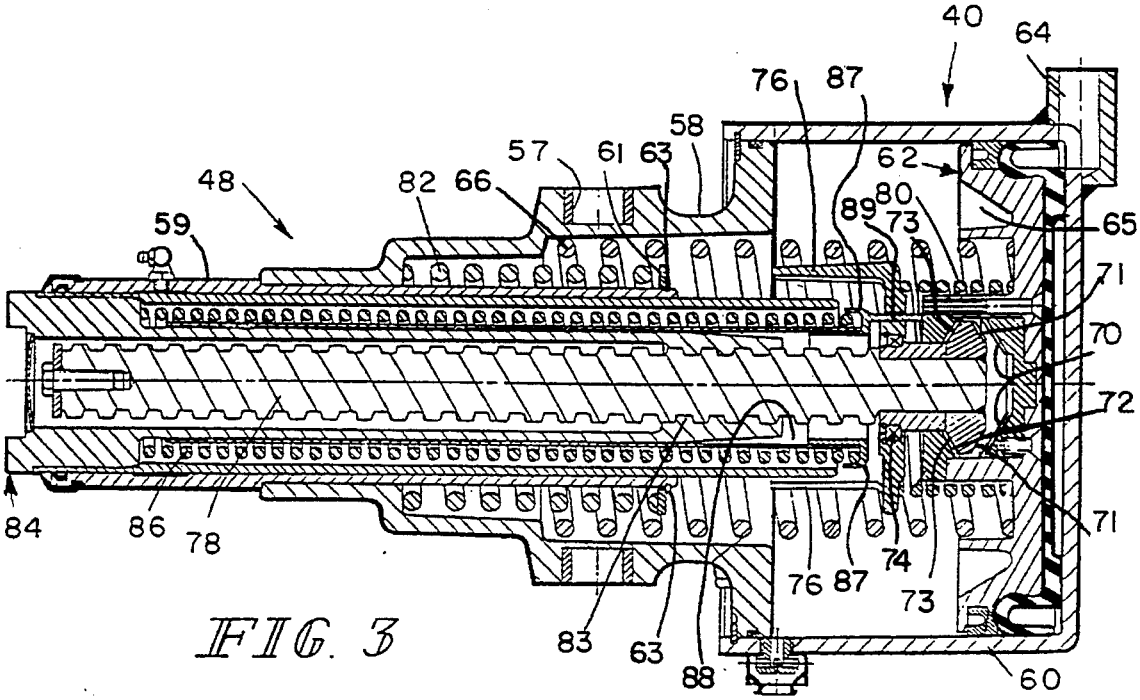
FIG. 3 is a cross sectional view of the actuator with slack adjuster taken along lines III—III of FIG. 1.

As illustrated in FIG. 3, the brake cylinder actuator 40 includes a body 60 and non-pressure head to form a housing. Piston 62 divides the interior of body 60 into a pressurized and unpressurized volumes. A port 64 admits the fluid pressure into the volume between the body 60 and the piston 62 to move the piston 62 to the left in brake applied position. Spring return 66 resting at one of its ends on the cylinder portion 58 and biases the piston 62 to the right.

The cylinder slack adjuster portion 48 includes a back female clutch face 70 and a front female clutch face 72 both mounted to the piston 62 cooperating with a corresponding back head clutch face 71 and front head clutch face 73 both part of the compensator screw 78. To address the problem of pulling force applied to the output of the slack adjuster by a hand brake application, as will be explained below, the front clutch faces 72,73 form a friction clutch while the back clutch faces 70,71 form a toothed clutch.

A bearing 74 rotationally mounts the screw 78 to a bearing cup 76. A cup spring 80 rests between the piston 62 and the bearing cup 76 and biases the front clutch faces 72,73 into engagement to prevent rotation of the screw 78. A spring 82 rest between the actuator internal housing portion 58 and a ring 61 slidable on sleeve 59 mounted to the housing portion 58 and retaining ring 63 on sleeve 59. The spring 82 is stronger than cup spring 80 so as to cause bearing cup 76 and the screw 78 and clutch faces 72,73 to stop moving to the left in FIG. 3 for continued leftward movent of the piston 62. This will cause clutch faces 72, 73 to disengage and allow rotation of the screw 78 until further travel to the left of the piston 62 relative to the cup 76 is terminated by the engagement of back clutch faces 70, 71.

A ram 84 is guided inside of the tube (sleeve) 59 and is threadably connected to the compensation screw 78 at threads 83. A ram spring 86 extends between the ram 84 and a flange 87 on sleeve 88 which engages the piston by follower 89 extending through bearing cup 76 holes. Spring 86 pushes ram 84 leftward when screw 78 rotates during the excessive slack. The slack adjuster 48 is a double acting slack adjuster integral with the actuator 40 or brake cylinder. The operation of the slack adjuster and the improvement will be described after the full description of the braking system.

A first force transmission element or push rod 90 extends from the cylinder slack adjuster 48 at ram portion 84 through the channel 38 in the bolster 22 and the passage hole 34 in the second brake beam 20. The rod 90 is connected at its other end by pin 92 to the left side of transfer levers 94. A pin 98 pivotally mounts the transfer levers 94 to a bracket 96 which is connected to the brake beam 20 by fasteners 100 extending through the mounting holes 32 and nuts 102. The bracket 96 has the passage hole 104, not shown, which aligns with the actuator passage 30 in the beam 20. A second force transmitting element or rod 106 has its first end connected to the right side of the transfer levers 94 by a pin 108. The force transmitting rod 106 extends through the aligned passage 104 in bracket 96 and the passage 30 in brake beam 20, through channel 38 in the bolster 22 and into the passage hole 34 of the first brake beam 18. A pin 110 extends through the preexisting mounting hole 36 in the beam 18 to connect the other end of rod 106 to the first brake beam 18.

The gimbal 50 and its connection to the first brake beam 18 allows the actuator 40 to freely maintain its axis of force application coaxial with the axis of the first force transmitting element or rod 90. This prevents twisting and bending of the ram 84 during the arc movement of levers 94 (horizontal movement) and brake beams (18, 20) movement in the side frame pockets up and down (vertical movement). Although the bracket 42 has been shown to be mounted to the preexisting mounting holes for a dual actuator beam system, it can be mounted to any brake beam as well as to brake beams which are not truck mounted.

Figure 4:
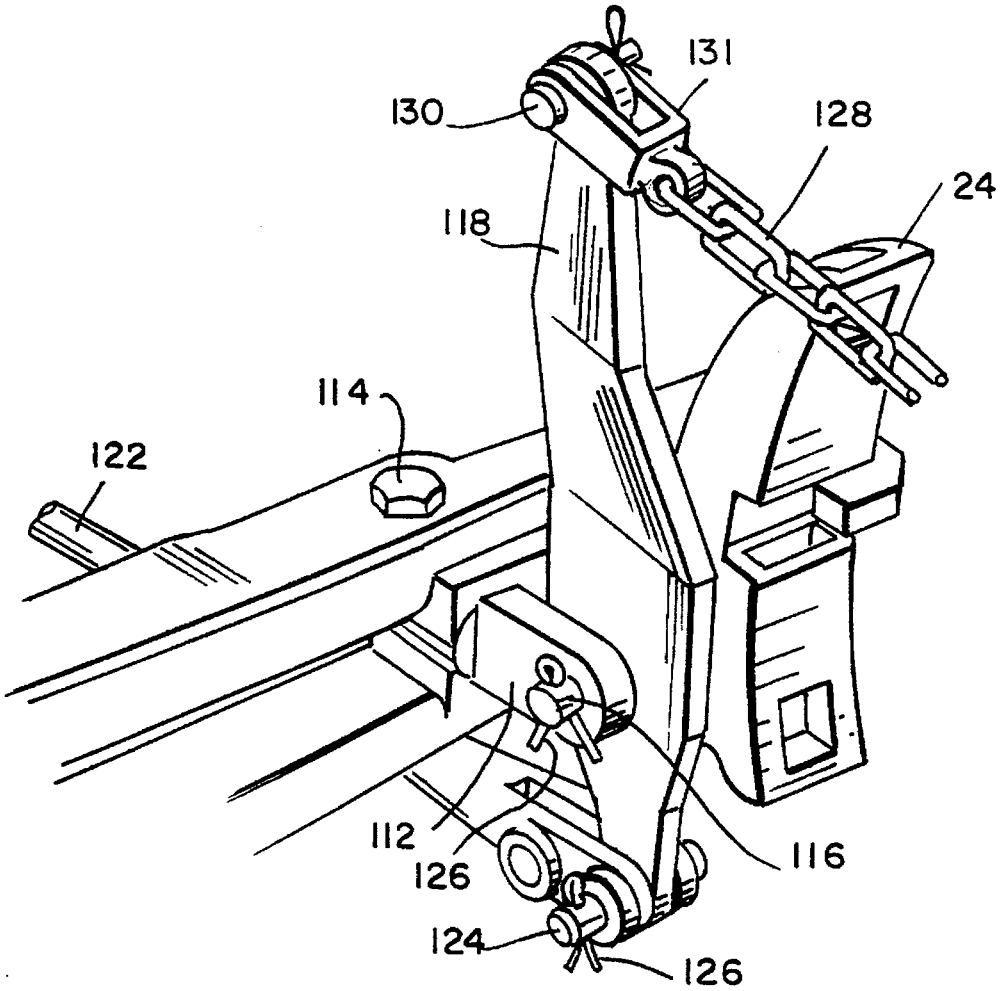
FIG. 4 is a partial perspective view of a hand brake linkage according to the principles of the present invention.

The hand brake illustrated in FIGS. 1 and 4 includes a fulcrum bracket 112 mounted to each of the brake beams 18 and 20 by beam pin 114. Lever 118 and 120 are mounted to the fulcrum bracket 112 of beams 18 and 20 respectfully by fulcrum pin 116. A push rod 122 is interconnected to the lower end of the levers 118 and 120 by push rod pins 124. Cotter pin 126 retains the push rod pins 124 and the fulcrum pins 116 in place. A hand brake chain 128 through clevis 131 is connected to the upper end of lever 118 by pin 130. A chain 132 is similarly connected to the upper end of lever 120 by a pin 134. The other side of the chain 132 is connected to the car body 135. The pulling force on chain 128 rotates the lever 118 transmitting force by rod 122 to separate the brake beams 18 and 20. This force separating the brake beams 18 and 20 is transmitted back through the brake actuation system as a pulling input through bracket 96, rod 106, levers 94 and rod 90. Although the hand brake directly applies the brakes through the brake beams, the pulling force on the cylinder slack adjuster determines the ram extension 84 relative to the actuator 40 as needed.

The slack adjuster in its release or non-brake position is illustrated in FIG. 3 with the front clutch 72, 73 engaged and back clutch 70, 71 disengaged. When air is applied to the cylinder through port 64, the piston 62 and the whole internal mechanism moves to the left. The front clutch 72, 73 remains locked by the force of cup spring 80. Movement of the screw 78 is stopped by the bearing cup 76, ring 61 and spring 82. If excess slack remains or exists, piston 62 continues to move to the left against spring 82, causing front clutch 72 and 73 to disengage and allowing the screw 78 to rotate. This allows spring 86 to move the ram 84 forward until the brake shoes 24 contact the wheels. Piston 62 continues moving to the left until the back clutch 70 and 71 is locked. The cylinder starts to buildup braking force with the back clutch 70, 71 locked.

When the brakes are to be released, fluid at port 64 is evacuated and the return spring 66 moves the piston 62 to the right with the whole internal mechanism. The back clutch 70, 71 disengaged when bearing cup 76 moves right and the force of the spring 80 overcomes force of the spring 82. Piston 62 still moves to the right increasing the clearance between the cup bearing 76 and ring 61. The force of the spring 80 moves the screw 78 and ram 84 to the left-locking the front frictional clutch 72, 73 and preventing the screw 78 from rotating.

For a hand brake application, the pulling forces are applied to the ram 84. When the slack is smaller than the maximum piston stroke defined by the distance between piston 62 and front of the non-pressure head 58, clutch 72, 73 remains locked and in contact. When the slack is greater than the maximum piston stroke, ram 84 with locked clutch 72, 73 move to the left until cup 76 intersects the ring 61. The force of spring 82 through ring 61 overcomes the cup spring 80. Ram 84 continues to move left until the hand brake force overcomes the friction torque between the front clutch faces 72, 73. Screw 78 then begins to rotate and force of spring 86 moves ram 84 forward. This increases the length of the ram 84 as needed. The friction clutch 72, 73 guarantees the full contact between the shoes 24 and all wheels. The friction clutch 72, 73 guarantees the extension of the cylinder length and takes up the slack if needed when the hand brake forces apply to the beams. When brake shoes are changed out, retraction of the cylinder ram 84 is normally necessary. Thus, if the piston is not actuated by air prior to a hand brake application, a substantial amount of excess slack must be taken up during the first initial hand brake application.

During the release of the hand brake, the springs 82 and 66 return the actuator's piston to the release position.

In review, the front clutch 72 and 73 is engaged at the beginning of the air applied brakes and disengages when the control distance defined between ring 61 and cup 76 is exceeded. At this point, clutches 72, 73 and 70, 71 are disengaged and allow rotation of the screw 78. Once the brake shoes have engaged the wheel, the back clutch 70 and 71 engage for the remainder of the travel or force application of the brakes. In a hand brake application, the front clutch 72 and 73 are engaged at the beginning and through a substantial portion of the travel of the actuator and remain engaged but not locked for slack adjusting and to the end of the travel. Any excess force overcomes the frictional forces of the clutch to allow relative movement even though they are not disengaged. Back clutch 70 and 71 are always disengaged during the hand brake application.

Although the present invention has been described and illustrated in detail, it is to be clearly understood that the same is by way of illustration and example only, and is not to be taken by way of limitation. The hand brake may be applied directly to any of the elements or rods 90, 106 or levers 94 directly instead of just through the brake beam 18 and 20. Also, the specific adjuster and the two clutches including faces 70, 71 and 72, 73 are by way of example. The important element being the relation that the front clutch 72, 73 or the clutch related to preventing rotation of the screw during the initial application or extension of the ram be a clutch which is capable of being disengaged for excessive pulling forces on the ram 84. Similarly, the present invention may be used with a spring applied, air release brake cylinder. The spirit and scope of the present invention are to be limited only by the terms of the appended claims.

What is claimed:

1. A brake actuator for a rail vehicle's brake comprising:

a piston in a housing responsive to fluid pressure for actuating a brake;

a ram extending from said housing for connecting said actuator to said brake; and a slack adjuster for adjustably interconnecting said piston and said ram as a function of the length of travel of the ram between its brake released and brake applied positions;

said slack adjuster including a screw threadably connected to and rotatable with respect to said ram, a first clutch for preventing rotation of said screw for a first relative position of said piston to said screw, a second clutch for preventing rotation of said screw for a second relative position of said piston to said screw, and said screw being rotatable for relative positions of said piston to said screw between said first and second relative positions, said first clutch being a friction clutch to allow rotation of said screw for excess force on said ram pulling said screw toward a relative position with respect to said piston beyond said first relative position and out of relative positions between said first and second relative positions and wherein said second clutch is a toothed clutch.

2. A brake actuator according to claim 1, including a return spring for biasing said piston in opposition to said fluid pressure.

3. A brake actuator according to claim 2 wherein said actuator is fluid pressure applied brake actuator.

4. A brake actuator according to claim 1, including means for connecting a hand brake arrangement to said ram.

5. A brake actuator according to claim 4, wherein, in response to fluid actuation, said piston and screw are in said first relative position at the beginning of and in said second relative position at the end of the extension of said ram; and, in response to hand brake actuation, said piston and screw are in said first relative position at the beginning and end of the extension of said ram.

6. A brake actuator according to claim 1, wherein, in response to fluid actuation, said piston and screw are in said first relative position at the beginning of and in said second relative position at the end of the extension of said ram; and, in response to a pulling force on said ram, said piston and screw are in said first relative position at the beginning and end of the extension of said ram.

7. A brake system for a railway vehicle comprising:

first and second brake beams;

a transfer lever pivotally connected at a point intermediate the ends thereof to said second brake beam;

first and second force transmitting means each having a second end connected to opposite arms of said transfer lever and a force transmitting axis, and a first end of said second force transmitting means being connected to said first brake beam;

actuator means mounted to said first beam and connected to a first end of said first force transmitting means for controlling the position of said force transmitting means along a force application axis in response to fluid pressure;

first and second hand brake levers pivotally connected at a point intermediate the ends thereof to said first and second brake beam, respectively;

a first end of said first hand brake lever being connected to a hand brake actuator and a first end of said second hand brake lever being connected to the vehicle;

third force transmitting means interconnecting second ends of said hand brake levers;

said actuator means including a piston responsive to said fluid pressure, a ram connected to said first force transmitting means and a slack adjuster for adjustably interconnecting said piston and said ram as a function of the length of travel of the ram between its brake released and brake applied positions;

said slack adjuster including a screw threadably connected to and rotatable with respect to said ram, a first clutch for preventing rotation of said screw for a first relative position of said piston to said screw, a second clutch for preventing rotation of said screw for a second relative position of said piston to said screw, and said screw being rotatable for relative positions of said piston to said screw between said first and second relative positions, said first clutch being a friction clutch to allow rotation of said screw for excess pulling force on said ram produced by said hand brake and wherein said second clutch is a toothed clutch.

8. A brake actuator according to claim 7, including a return spring for biasing said piston in opposition to said fluid pressure.

9. A brake actuator according to claim 7, wherein, in response to fluid actuation, said piston and screw are in said first relative position at the beginning of and in said second relative position at the end of the extension of said ram; and, in response to hand brake actuation, said piston and screw are in said first relative position at the beginning and end of the extension of said ram.

* * * * *